US005137334A

United States Patent [19]

Cheney et al.

[11] Patent Number: 5,137,334

[45] Date of Patent: Aug. 11, 1992

[54] SAFETY DEVICE FOR RESTRAINING A CHILD IN A CHAIR

[76] Inventors: Terry A. Cheney; Donna L. Cheney, both of 5711 Bogue Rd., Yuba City, Calif. 95991

[21] Appl. No.: 168,946

[22] Filed: Mar. 16, 1988

[51] Int. Cl.[5] ..... A47C 7/62; A47D 15/00

[52] U.S. Cl. ..... 297/467

[58] Field of Search ..... 297/464, 462, 485; 5/431

[56] References Cited

U.S. PATENT DOCUMENTS

| | | | |
|---|---|---|---|
| 409,402 | 8/1889 | Hough | 297/464 X |
| 928,305 | 7/1909 | Carrington . | |
| 1,237,301 | 8/1917 | Cooney . | |
| 1,376,625 | 5/1921 | Johnston . | |
| 2,218,951 | 10/1940 | Flaharty | 297/250 |
| 2,652,883 | 9/1953 | Holtzendorff | 297/467 X |
| 2,784,775 | 3/1957 | Madsen . | |
| 3,037,813 | 6/1962 | Lowe | 297/467 |
| 3,572,830 | 3/1971 | Storer | 297/467 |
| 4,190,287 | 2/1980 | Lemisch et al. | 297/467 X |
| 4,568,125 | 2/1986 | Sckolnik | 297/467 |
| 4,650,246 | 3/1987 | Henriksson . | |
| 4,676,554 | 6/1987 | Harlick et al. | 297/467 |
| 4,712,833 | 12/1987 | Swanson | 297/464 X |
| 4,795,216 | 1/1989 | Culver et al. | 297/467 |

*Primary Examiner*—Peter R. Brown
*Attorney, Agent, or Firm*—Bernhard Kreten

[57] ABSTRACT

A safety device to be used in combination with a chair adapted to support a child and preclude the possibility of a child sliding down from a front edge portion of a chair including a platform having a top surface upon which the infant resides, a bottom surface supported on a chair seat, and an upwardly extending horn adjacent the front edge of the safety device platform which is interposed between the two legs of the baby to preclude the baby's motion off of the chair. The safety device is attached to the chair by means of strands of cord at the intersection of a rear edge and lateral edges of the safety device with the strands of cord extending to the chair.

1 Claim, 2 Drawing Sheets

FIG 5
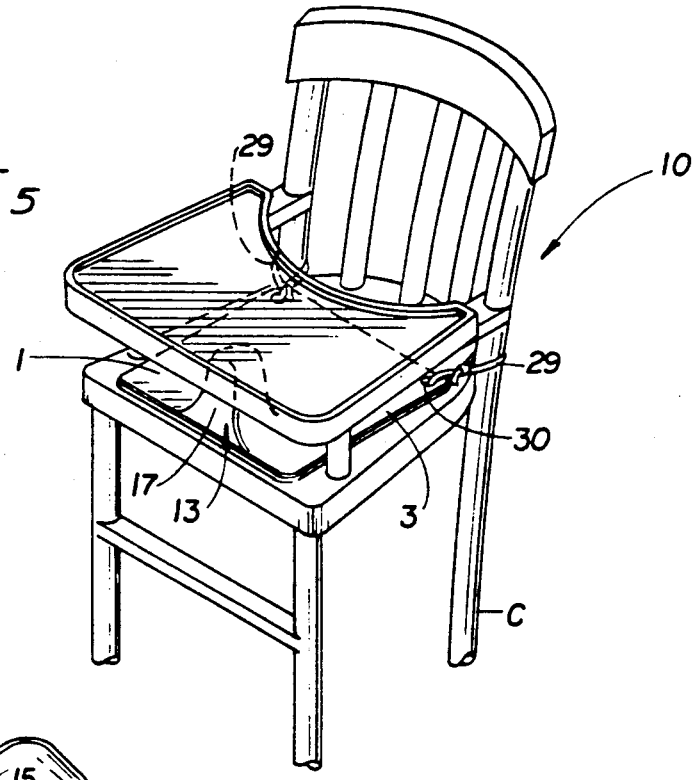
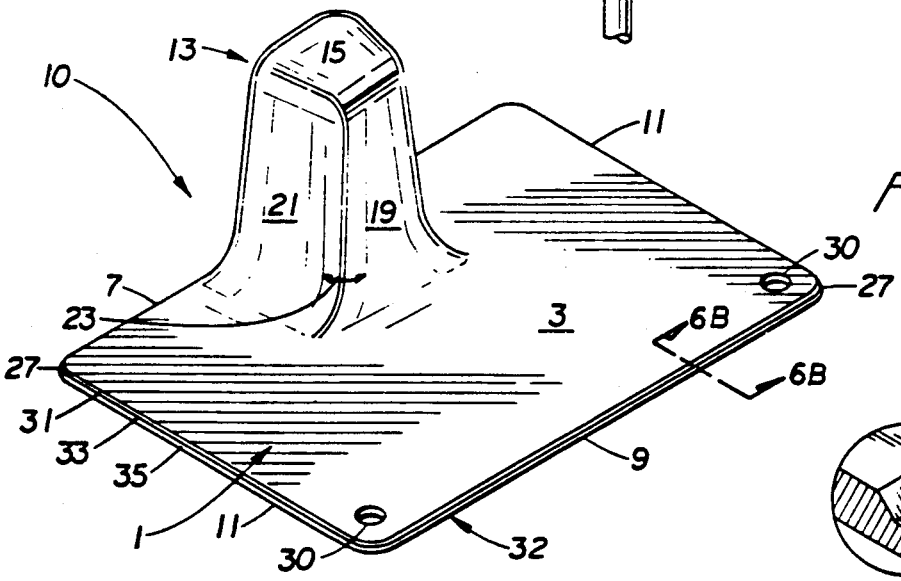
FIG 6A
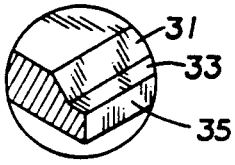
FIG 6B

SAFETY DEVICE FOR RESTRAINING A CHILD IN A CHAIR

FIELD OF THE INVENTION

The following invention relates to a restraining device for keeping a child of tender years in a chair. The device primarily thrwarts the tendency of the child to slide out of the chair through a leg access opening common to most high chairs having a table integral therewith.

BACKGROUND OF THE INVENTION

Children not old enough to use conventional, adult size chairs commonly are relegated to high chairs, booster chairs or the like. While the utmost safety for the child is assured when the parent is constantly watchful and vigilant, the exigencies of parenting frequently require a parent's attention to be diverted for one of a multitude of reasons.

While young children are not necessarily obstreperous, they are however, quite animated and restless as well as unsteady as they test and build up their strength with respect to the available surroundings.

When a child is confined in a high chair, the most frequent way to avoid the restraint of having a table placed in front of the child is for the child to slide underneath the table and attain freedom on the ground. Some high chairs are at an elevated distance above the ground, but this sliding to escape is seldom dangerous unless the child does not land stably, feet first. This is unwanted by the parent because the child may hit his/her face on the tray as they slide under it or fall upon landing.

In addition, children of tender years are likely to rock in the chair imparting unwanted motion to the chair. If the child is effectively restrained into the chair, the rocking motion can be imparted directly to the chair providing an unwanted result if the chair should translate or become unstable.

The following patents reflect the state of the art of which applicant is aware and is intended primarily to discharge applicant's acknowledged duty to disclose relevant prior art.

U.S. Pat. No. 1,237,301—Cooney
U.S. Pat. No. 2,784,775—Madsen
U.S. Pat. No. 928,305—Carrington
U.S. Pat. No. 1,376,625—Johnston
U.S. Pat. No. 4,650,246—Henriksson
U.S. Pat. No. 3,572,830—Storer The patent to Cooney teaches the use of a chair attachment wherein a telescoping member extends between a seat surface upon which the infant or child resides and the telescoping member is fixed to a bottom surface of a tray common to most high chairs. It should be clear that this attachment is fixed so that it depends from the chair tray.

The patent to Madsen teaches the use of a restraining post attachment for high chairs in which the post 30 is attached to the chair by means of a "U" shaped bracket having screws 26 fastened to a bottom surface thereof to the secure the post for subsequent use. Thus, the restraining post does not and can not move relative to its support surface. In addition, the screws 26 which clamp to the bottom surface of the chair are readily exposed, providing a hazard.

The patent to Carrington teaches the use of a chair strap for holding infants, in which the strap girds the waist area of the baby and has a front strap portion which extends between the legs of the baby and attaches on to the chair. By having the restraint directly connected between the baby and the chair, baby motion will be imparted directly to the chair.

Similarly, the patent to Johnson teaches the use of a safety device for high chairs in which the appliance actually tethers the baby to the chair and therefore motion by the infant is imparted to the chair.

The patent to Hendrickson teaches the use of a baby chair in which the chair is formed as a bucket having a bar 36 circumscribing the front of the baby and a downwardly extending piece 39 which is intended to allow the baby's legs to straddle either side of the piece 39. This device is an integral unit effective only when all components comprising the invention are present.

The patent to Storer teaches the use of an all-purpose seat for children in which a tubular frame surrounds the child and a seat portion includes an upwardly extending horn so that the child is securely restrained. This integral unit does not lend itself to retrofit on pre-existing chairs that are already specialized for the purpose of serving a parent's need for a high chair.

SUMMARY OF THE INVENTION

The instant invention is distinguished over the known prior art in a plurality of ways. First, the safety device according to the present invention is configured as a platform of substantially planar configuration having a horn on a top surface thereof and tether means at corners remote from the horn to define a substantially generic appliance which allows placement of the device on a plurality of different types of chairs expeditiously without the need of any tools.

Secondly, since the platform is retrofitted onto an existing chair, motion by the child is transmitted only to the platform, and not to the chair since the platform is free to move with respect to the chair along one direction and within limits imposed by the tethers. Thus, most of the child's energy will not go to undermine the stability of the chair which supports the platform, but rather to move the platform itself.

Third, the child is not actually restrained by the device but merely restricted with respect to making certain movements more difficult. Thus, when compared to actual restraining devices which tie the infant to the chair this device gives the baby freedom of movement so that the baby's movement does not get transmitted directly to the chair. Moreover, the parent does not have to try and get the straps buckled and unbuckled to get the baby out of the high chair.

Because the platform and horn assembly are substantially neutral with respect to adaptability with other high chair instrumentalities, this device retrofits readily to all known baby chairs and could be used with a regular chair if one were out of one's home environment and didn't have a high chair. The criteria would be whether there is an area to tie the platform, preferrably adjacent a rear portion of the platform to the chair.

Although this area of patent literature is relatively rich with attempts to solve a long standing, yet heretofor unsatisfied need, none of the known prior art devices teach nor render obvious, neither singularly nor considered in any conceiveable combination that which is the nexus of the instant invention set forth with great particularity in the claims and as described in detail hereinafter.

OBJECTS OF THE INVENTION

It is a primary object of this invention to provide a novel and useful device for precluding a child's passage from a chair by providing a device which the infant straddles between his or her legs.

It is a further object of this invention to provide a device as characterized above which is transportable and readily affixable to all known high chairs or other types of chairs.

A further object of this invention contemplates a device as characterized above which is relatively simple to make, extremely durable in construction and lends itself to mass production techniques.

It is yet a further object of this invention to provide a device as characterized above which allows one attending a child while the child is in a chair to do so with a higher degree of safety than has heretofore been experienced in the known prior art.

A further object of this invention provides a device as characterized above in which the device is configured as a support platform and an associated integral horn which is merely tethered to an underlying chair support and capable of motion with respect to the chair support to absorb excess baby energy in a harmless manner.

A further object of this invention is to allow the baby unrestricted movement within certain limitations and to preclude transmission of the baby motion to the associated chair which supports the baby.

A further object of this invention contemplates providing a device as characterized above which is free from sharp or pointed projections for the attendant benefits.

These and other objects will be made manifest when considering the following detailed specification and considered with the appended drawing figures.

BRIEF DESCRIPTION OF THE DRAWING FIGURES

FIG. 5 is a perspective view of the apparatus according to the present invention in its intended environment.

FIG. 6A is a perspective view of the apparatus according to the present invention.

FIG. 6B is a detail of that which is shown in FIG. 6A taken along lines 6B—6B.

BRIEF DESCRIPTION OF THE PREFERRED EMBODIMENT

Figure 1:
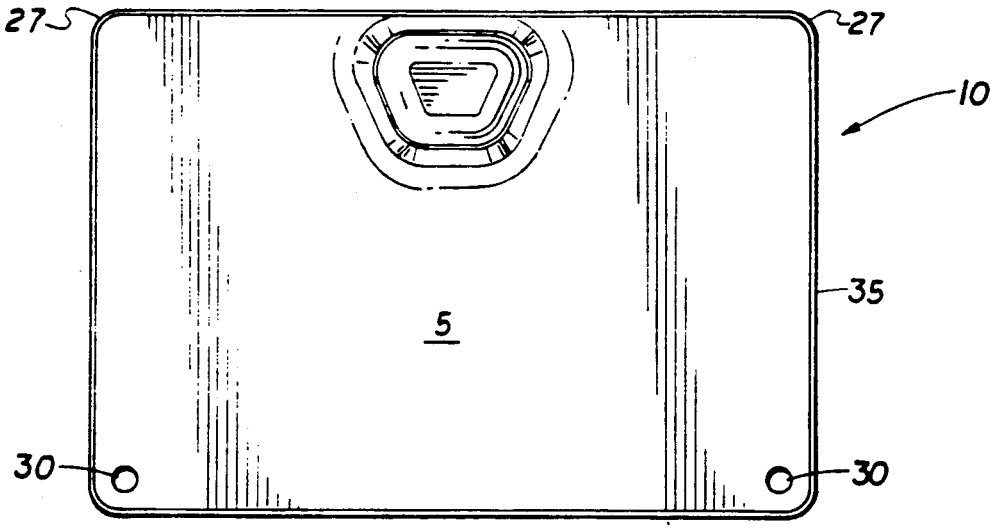
FIG. 1 is a bottom plan view of the apparatus according to the present invention.
Figure 2:
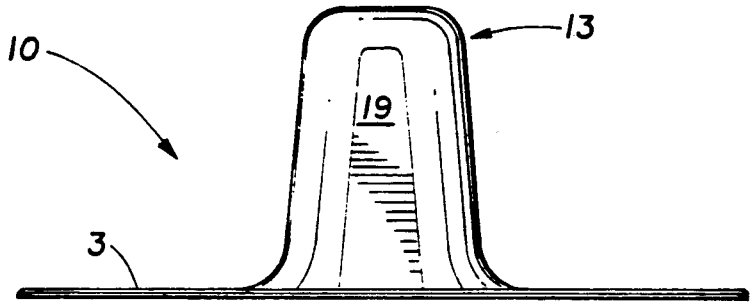
FIG. 2 is a rear view from that which is shown in FIG. 1.
Figure 3:
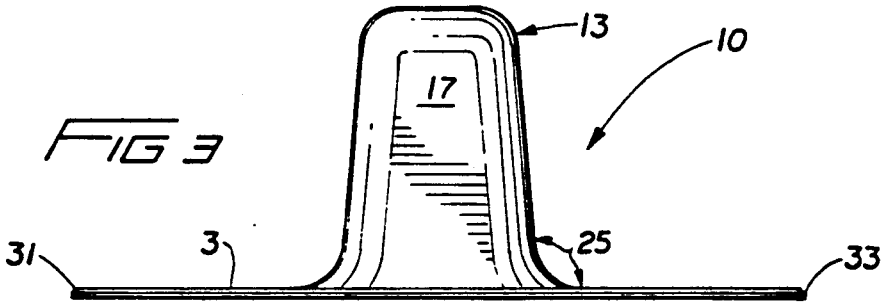
FIG. 3 is a front view.
Figure 4:
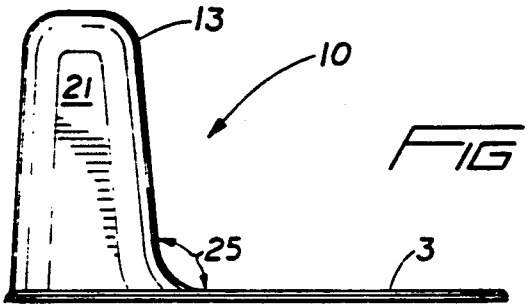
FIG. 4 is a side view.

Referring to the drawings now, wherein like reference numerals refer to like parts throughout the drawing figures, reference numeral 10 is directed to the safety device according to the present invention.

With particular reference to FIG. 5, the safety device 10 is shown on a chair for use in restraining an infant or young child in a safe manner. The chair can be of any configuration and is not per se a part of the invention except to the extent that a rear portion of the chair should have some way by which the safety restraining device can be attached.

In its most elemental form, the safety device 10 includes a platform 1 and a horn 13 on an edge of the platform adjacent a "front" of the chair so that a child placed on the chair cannot slide towards the front of the chair and escape or fall out. More particularly, the platform 1 includes a top surface 3, a bottom surface 5, the bottom surface in contact with a seat area of the chair C. The platform 1 includes a front edge 7, a rear edge 9 and lateral edges 11 thereby defining a substantially rectangular blank formed from a class of materials which benefit from mass production, such as plastic which is easily moldable, cleanable and relatively "soft".

Adjacent the front edge 7 of the platform 1, a horn 13 is provided on the top surface to extend upwardly in the following manner. The horn 13 is configured as a pyramid having a plurality of upstanding walls and a top wall 15, thereby forming a truncated pyramid. Specifically, the horn 13 includes a front wall 17, a rear wall 19 and a pair of opposed side walls 21 which declinate upwardly and inwardly to form the horn when taken in conjunction with the top wall 15. The pyramid thus formed is truncated and the intersection between adjacent walls is radiused so that no sharp edges are provided. In particular, between adjacent walls on the pyramid, the radiused corners 23 are one-half inch. In addition, the front wall 17 is substantially twice the dimension of the rear wall 19 at its topmost extremity, just below the top wall. This front wall width is one inch. At a comparable topmost portion, each side wall has the same width as the rear wall 19, i.e. one-half inch.

In addition, the transition 27 between the pyramid and the top surface 3 of the platform 1 is also radiused, with the preferred radius being 5/8 of an inch to provide a gentle transition.

The front wall 17 is angled inwardly at an angle of three degrees. The rear wall 19 and side walls 21 are inclined inwardly (with respect to a center of the horn 13) at an angle of five degrees.

In a preferred form of the invention, the horn 13 is integrally formed with the platform 1 by means of stamp forming or injection molding so that the bottom surface 5 of the safety device includes a hollow corresponding to the pyramid on its opposed face.

In addition, the top and bottom surfaces 3, 5 respectively of the platform 1 have corners 27 between the lateral edges 11 and front 7 and rear 9 edges which are radiused at approximately ¾ of an inch so that these areas are similarly smooth. The intersection of the side 11 and rear 9 edges also have somewhat inboard therefrom a pair of holes 30 which receive tether means 29 for support and attachment to the chair C. In a preferred form of the invention the tether means are strands of cord or elastic.

Attention is directed to FIG. 6A which shows that the periphery of the platform 1 is configured as a two step flange 32. The first downwardly declinated portion 31 is at 45 degrees with respect to the vertical, and a transition shelf 33 exists between the 45 degree flange and a vertically downwardly extending peripheral ridge 35. Thus, should this device be constructed with a specific chair in mind the ridge can circumscribe a chair of specific dimension and nest securely thereon. Normally, the downwardly extending ridge provides an edge which sits upon the seat portion of a chair C and supports the child. This allows the chair platform 1 to deform somewhat and conform to the infant.

Having thus described the invention, it should be apparent that numerous structural modifications and adaptations may be resorted to without departing from the scope and fair meaning of the instant invention as defined above and as claimed hereinbelow.

We claim:

1. A device to deter a child from leaving a chair which has a seat, a back, arms and a front seat edge remote from the chair back, comprising, in combination:

a platform carried on the seat of the chair and fixed thereto by a plurality of flexible tethers extending from said platform to the chair such that, said platform is constrained from removal from the chair but moves with respect to the chair, and an upwardly extending horn formed on a top surface of said platform, adjacent the front edge of the chair so that when the child sits on the chair and straddles said horn, the child cannot slide from the chair but can move without affecting the chair's stability, wherein said horn is generally configured as an upwardly tapering four sided pyramid having a top wall, front and rear walls connected by side walls, and with radiused areas of transition between each adjacent said pyramid wall to provide no sharp edges or projections, wherein each intersection lateral, front and rear edge of said platform is radiused at ¾ of an inch, wherein said front wall of said pyramid horn terminates at a lowermost portion adjacent to said platform front edge and tapers upwardly and inboard said front edge at an angle of three degrees from a vertical plane, wherein said pyramid rear wall and side walls are tapered inwardly and upwardly at an angle of 5 degrees from vertical, wherein transition between said pyramid rear and side walls are radiused with respect to said platform by a 5/8 of an inch radius, wherein said radius between said top wall, said front and rear pyramid walls and said pyramid side walls are ½ of an inch radius, wherein the width of a planar topmost portion of said pyramid's rear wall and said side wall are ½ of an inch, and said front wall width at the same vertical elevation is one inch, wherein said tether means is a strand of cord, and wherein a periphery of said platform defines a two step flange with a downwardly extending peripheral ridge.

* * * * *